US011401693B2

(12) United States Patent
Kim et al.

(10) Patent No.: US 11,401,693 B2
(45) Date of Patent: Aug. 2, 2022

(54) REGENERATION SYSTEM AND METHOD OF ENERGY RELEASED FROM WORKING IMPLEMENT

(71) Applicant: VOLVO CONSTRUCTION EQUIPMENT AB, Eskilstuna (SE)

(72) Inventors: Dong Soo Kim, Daegu (KR); Tae Rang Jung, Gyeongsangnam-do (KR); Sang Min Gwon, Gyeongsangnam-do (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 0 days.

(21) Appl. No.: 17/279,993

(22) PCT Filed: Sep. 27, 2018

(86) PCT No.: PCT/KR2018/011351
§ 371 (c)(1),
(2) Date: Mar. 25, 2021

(87) PCT Pub. No.: WO2020/067584
PCT Pub. Date: Apr. 2, 2020

(65) Prior Publication Data
US 2022/0002964 A1 Jan. 6, 2022

(51) Int. Cl.
*E02F 9/22* (2006.01)
*F15B 21/14* (2006.01)
(Continued)

(52) U.S. Cl.
CPC ..... *E02F 9/2217* (2013.01); *E02F 9/2267* (2013.01); *F15B 1/024* (2013.01);
(Continued)

(58) Field of Classification Search
CPC ..... F15B 1/024; F15B 21/14; E02F 9/2217
See application file for complete search history.

(56) References Cited

U.S. PATENT DOCUMENTS 6,655,136 B2 * 12/2003 Holt ..... E02F 9/2207 60/414
6,748,738 B2 * 6/2004 Smith ..... E02F 9/2217 60/414
(Continued)

FOREIGN PATENT DOCUMENTS

CN 104452867 A 3/2015
CN 105026773 A 11/2015
(Continued)

OTHER PUBLICATIONS

International Search Report and Written Opinion of the International Searching Authority, PCT/KR2018/011351, dated Jun. 29, 2019, 10 pages.
(Continued)

*Primary Examiner* — Michael Leslie
(74) *Attorney, Agent, or Firm* — Sage Patent Group

(57) ABSTRACT

An embodiment of the present invention provides a regeneration system of energy released from a working implement, which includes an actuator configured to move up and down the working implement, an accumulator configured to communicate with the actuator, and a controller configured to receive a pressure value of the actuator and a pressure value of the accumulator to control a discharge operation of the accumulator based on a pressure difference value between the actuator and the accumulator.

16 Claims, 3 Drawing Sheets

(51) Int. Cl.

| | |
|---|---|
| ***F15B 1/02*** | (2006.01) |
| *E02F 3/32* | (2006.01) |
| *E02F 9/20* | (2006.01) |

(52) U.S. Cl.

CPC ..... *F15B 21/14* (2013.01); *E02F 3/32* (2013.01); *E02F 9/2091* (2013.01); *F15B 2211/212* (2013.01); *F15B 2211/30575* (2013.01); *F15B 2211/88* (2013.01)

(56) References Cited

U.S. PATENT DOCUMENTS

| | | | | |
|---|---|---|---|---|
| 7,905,088 | B2 * | 3/2011 | Stephenson | F15B 11/024 60/414 |
| 8,689,550 | B2 * | 4/2014 | Wada | E02F 9/2217 60/414 |
| 9,279,236 | B2 * | 3/2016 | Zhang | E02F 9/2296 |
| 9,879,404 | B2 * | 1/2018 | Schroeder | F15B 1/024 |
| 10,174,770 | B2 * | 1/2019 | Zhang | F15B 11/024 |
| 2007/0186548 | A1 | 8/2007 | Smith et al. | |
| 2013/0221746 | A1 | 8/2013 | Nakayama | |
| 2014/0208728 | A1 * | 7/2014 | Ma | F15B 11/042 60/327 |
| 2016/0333903 | A1 | 11/2016 | Peterson et al. | |

FOREIGN PATENT DOCUMENTS

| | | | |
|---|---|---|---|
| CN | 108138468 | A | 6/2018 |
| EP | 1979551 | B1 | 3/2015 |
| WO | WO 2017/099265 | A1 | 6/2017 |

OTHER PUBLICATIONS

Office Action dated Apr. 26, 2022, Chinese Patent Application No. 201880097503.1, 9 pages.

* cited by examiner

[Fig. 1]
100
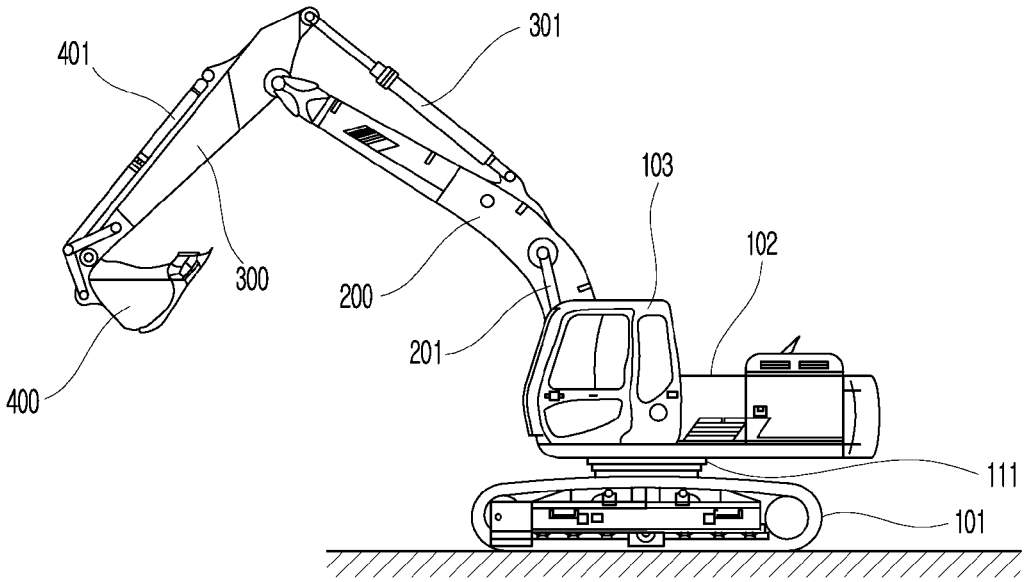

[Fig. 2]
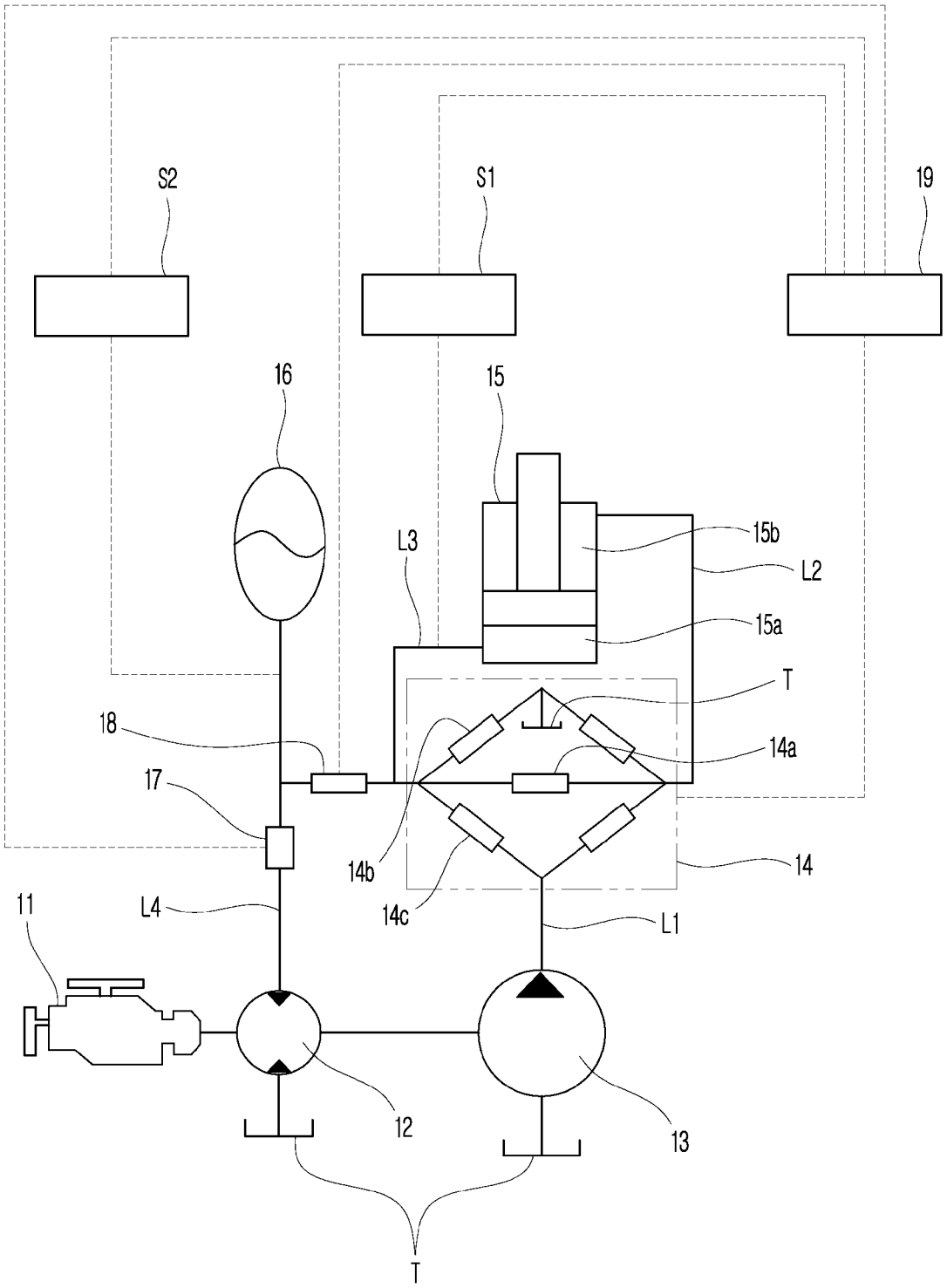

[Fig. 3]
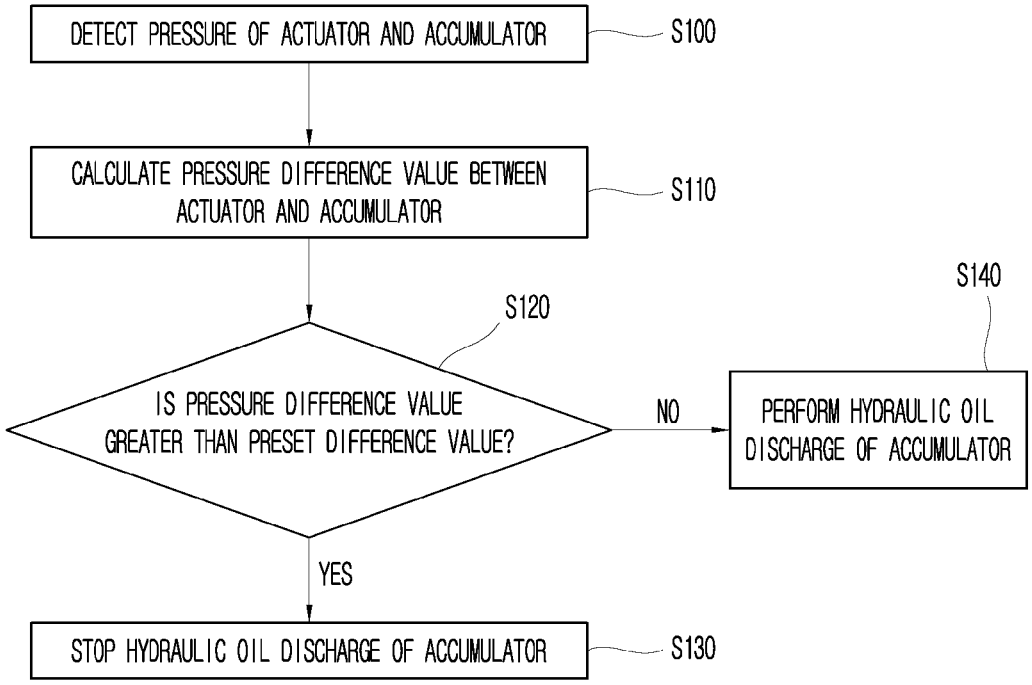
[Fig. 4A]
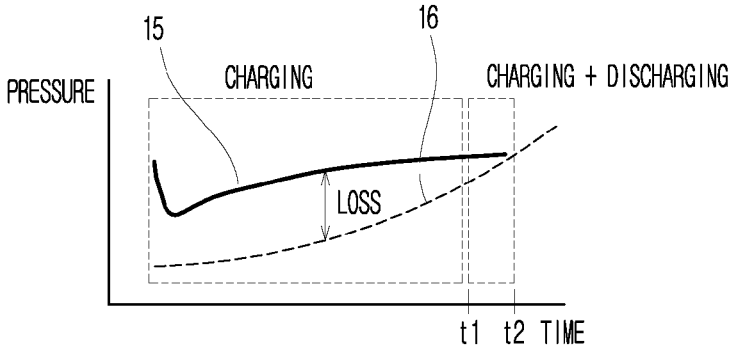
[Fig. 4B]
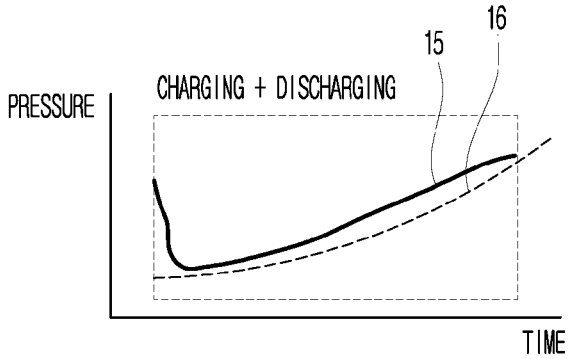

REGENERATION SYSTEM AND METHOD OF ENERGY RELEASED FROM WORKING IMPLEMENT

CROSS REFERENCE TO RELATED APPLICATIONS

This application is a 35 U.S.C. § 371 national stage application of PCT International Application No. PCT/KR2018/011351 filed on Sep. 27, 2018, the disclosure and content of which is incorporated by reference herein in its entirety.

TECHNICAL FIELD

The present invention relates to a regeneration system and method of energy released from a working implement, and more specifically, to a regeneration system and method of energy released from a working implement, which controls charging and discharging of hydraulic oil for an accumulator according to a pressure difference between an actuator and the accumulator.

BACKGROUND ART

In general, construction equipment such as an excavator generates a great force by using hydraulic pressure.

Such a great force allows a working implement of the excavator to excavate soils or rocks or to stack the excavated soils or rocks.

A hydraulic pump is provided to utilize the hydraulic pressure. The hydraulic pump pumps oil stored in an oil tank to supply hydraulic oil to an actuator that drives the working implement.

In order to operate the hydraulic pump, it is necessary to operate an engine and, in order to operate the engine, fuel consumption is required.

An energy regeneration technology is used to increase the fuel efficiency of construction equipment by reducing the fuel consumption.

According to the energy regeneration technology, hydraulic oil supplied to an actuator is not discharged to an oil tank, but rather charged in an accumulator when the working implement descends in a motion of free fall and the charged hydraulic oil is supplied to another hydraulic equipment.

In the energy regeneration technology, when an energy regeneration rate is low or when it is necessary to increase the energy regeneration rate according to the pressure condition of the accumulator, there is a problem in that the reaction of an excavator is slowed down. Therefore, an energy regeneration system capable of efficiently regenerating energy is required.

Technical Problem

The present invention is directed to providing a regeneration system and method of energy released from a working implement, capable of improving the energy regeneration efficiency by maintaining pressure of an accumulator at an optimal state when energy is regenerated and the regenerated energy is reused for equipment, from which the energy is regenerated, during the operation of construction equipment.

Technical Solution

One aspect of the present invention provides a regeneration system of energy released from a working implement, the regeneration system including an actuator configured to move up and down the working implement, an accumulator configured to communicate with the actuator and a controller configured to receive a pressure value of the actuator and a pressure value of the accumulator to control a discharge operation of the accumulator based on a pressure difference value between the actuator and the accumulator.

The control unit may control the accumulator to stop the discharge operation when the pressure difference value is greater than a preset difference value.

The control unit may control the accumulator to perform the discharge operation when the pressure difference value is smaller than a preset difference value.

The regeneration system may further include a first sensor configured to detect an internal pressure of the actuator.

The regeneration system may further include a second sensor configured to detect a pressure of oil accumulated in the accumulator.

The regeneration system may further include a first oil line configured to communicate a main pump for generating a hydraulic pressure with the actuator.

The regeneration system may further include a second oil line disposed between the first oil line and a small chamber of the actuator.

The regeneration system may further include a third oil line configured to communicate the accumulator with a large chamber of the actuator.

The regeneration system may further include a fourth oil line configured to communicate the third oil line with a hydraulic motor.

The regeneration system may further include a first opening/closing valve disposed between the hydraulic motor and the accumulator.

The regeneration system may further include a second opening/closing valve disposed between the accumulator and the large chamber.

The first opening/closing valve may be controlled to be closed when the pressure difference value is greater than the preset difference value.

The first opening/closing valve may be controlled to be opened when the pressure difference value is smaller than the preset difference value.

A valve unit may be disposed between the first oil line and the second oil line, and the valve unit may include a first control valve which is controlled to be opened or closed such that the small chamber selectively communicates with the third oil line, a second control valve which is controlled to be opened or closed such that the third oil line selectively communicates with an oil tank, and a third control valve which is controlled to be opened or closed such that the third oil line selectively communicates with the main pump.

The first control valve may be closed and the second control valve may be opened when the pressure difference value is greater than the preset difference value.

The first opening/closing valve may be controlled to be closed when a detection value detected by the second sensor is lower than a preset pressure in a process of charging the accumulator with a hydraulic oil.

The second opening/closing valve may be controlled to be closed when it is determined that an oil pressure of the accumulator is higher than an oil pressure of the actuator according to the pressure difference value.

Another aspect of the present invention provides a regeneration method of energy released from a working implement of a working vehicle including an actuator for moving up and down the working implement and an accumulator configured to communicate with the actuator, the regeneration method including detecting a pressure of the actuator and a pressure of the accumulator, obtaining a pressure difference value between the actuator and the accumulator, comparing the pressure difference value with a preset difference value, and controlling the accumulator to stop a discharge operation when the pressure difference value is greater than the preset difference value.

The regeneration method may further include performing the discharge operation of the accumulator when the pressure difference value is smaller than the preset difference value.

Advantageous Effects

According to an aspect of the present invention, the energy regeneration efficiency can be improved by maintaining pressure of an accumulator at an optimal state when energy is regenerated and the regenerated energy is reused for equipment, from which the energy is regenerated, during the operation of construction equipment.

It should be understood that the effects of the present invention are not limited to the effects described above, but include all effects that can be deduced from the detailed description of the present invention or the constitution of the invention described in the claims.

DESCRIPTION OF DRAWINGS

FIG. 1 is a view illustrating a working vehicle to which a regeneration system of energy released from a working implement according to an embodiment of the present invention is applied.

FIG. 2 is a schematic view illustrating a hydraulic circuit used in the regeneration system of energy released from the working implement according to the embodiment of the present invention.

FIG. 3 is a flowchart illustrating the regeneration method of energy released from the working implement according to the embodiment of the present invention.

FIG. 4 is a time-pressure graph according to a pressure difference value between an actuator and an accumulator used in the regeneration system of energy released from the working implement according to the embodiment of the present invention.

MODES OF THE INVENTION

Hereinafter, the present invention will be described with reference to the accompanying drawings. The present invention may, however, be embodied in many different forms and should not be construed as limited to the embodiments set forth herein. In order to clearly illustrate the present invention, parts not related to the description are omitted, and like parts are denoted by like reference numerals throughout the specification.

Throughout the specification, when a part is referred to as being "connected" to another part, it includes not only being "directly connected" but also "indirectly connected" with another member interposed therebetween. Also, when a component is referred to as "including" another component in the present invention, it is to be understood that the component may further include other elements as well without excluding the other elements unless specifically defined otherwise.

Hereinafter, embodiments of the present invention will be described in detail with reference to the accompanying drawings.

FIG. 1 is a view illustrating a working vehicle to which a regeneration system of energy released from a working implement according to an embodiment of the present invention is applied, FIG. 2 is a schematic view illustrating a hydraulic circuit used in the regeneration system of energy released from the working implement according to the embodiment of the present invention, and FIG. 3 is a flowchart illustrating a regeneration method of energy released from the working implement according to the embodiment of the present invention.

As shown in FIGS. 1 to 3, the regeneration system of energy released from a working implement according to the embodiment of the present invention includes an actuator for moving up and down the working implement, an accumulator configured to communicate with the actuator, and a controller configured to receive a pressure value of the actuator and a pressure value of the accumulator to control a discharge operation of the accumulator based on a pressure difference value between the actuator and the accumulator.

In addition, the regeneration method of energy released from a working implement according to the embodiment of the present invention includes detecting a pressure of the actuator and a pressure of the accumulator (S100), obtaining a pressure difference value between the actuator and the accumulator (S110), determining whether the pressure difference value is greater than a preset difference value (S120), and stopping oil discharge of the accumulator when the pressure difference value is greater than the preset difference value (S130).

A working vehicle 100 to which the regeneration system of energy released from the working implement according to the present embodiment is applied may be provided.

An upper swing body 102, which is rotatable by a swing mechanism 111, may be mounted on a lower travelling body 101 of the working vehicle 100.

A boom 200, which is a working implement, may be mounted on the upper swing body 102. An arm 300, which is another working implement, is mounted on a front end of the boom 200, and a bucket 400, which is still another working implement, may be mounted on a front end of the arm 300.

The upper swing body 102 is provided with a cabin 103, and a power source such as an engine 11 may be mounted on the upper swing body 102.

A hydraulic motor 12 and a main pump 13 serving as a hydraulic pump may be connected to an output shaft (not shown) of the engine 11 serving as a mechanical drive unit.

The hydraulic motor 12 may be an assist motor. In this case, the hydraulic motor 12 is driven by receiving hydraulic oil supplied from an accumulator 16 described below and coaxially connected to the engine 11 to serve as an auxiliary power source.

The boom 200, the arm 300, and the bucket 400 may refer to working implements, and the bucket 400 may especially refer to a separately mountable attachment. The boom 200, the arm 300, and the bucket 400 may be hydraulically driven by a boom cylinder 201, an arm cylinder 301, and a bucket cylinder 401, which are hydraulic cylinders, respectively.

The boom cylinder 201 and the arm cylinder 301 may refer to an actuator 15 for driving and controlling working implements and various types of cylinders may be adopted in place of the boom cylinder 201 and the arm cylinder 301 to control various working implements of the working vehicle 100. In the following description, cylinders used for controlling the working implement will be collectively described as the actuator 15.

An operator may perform a loading work with an excavator by hydraulic pressure generated from the main pump 13 and may rotate a gear (not shown) connected to the upper swing body 102 at an angle of 360° by rotating a rotator installed in a swing motor (not shown) using the hydraulic pressure.

In addition, a first oil line L1 and a second oil line L2 for allowing the main pump 13 and the actuator 15 to communicate with each other may be provided in order to supply the hydraulic oil generated in the main pump 13 to the actuator 15.

The first oil line L1 may be arranged to allow the main pump 13 to communicate with a valve unit 14, and the second oil line L2 may be arranged to allow the valve unit 14 to communicate with a small chamber 15*b* of the actuator 15.

The valve unit 14 may be provided with a first control valve 14*a*, a second control valve 14*b*, and a third control valve 14*c* for controlling each component of the excavator of independent metering valve technology (IMVT) by using a control unit 19.

The first control valve 14*a* is controlled to be opened when oil is discharged from a large chamber 15*a* so that the hydraulic oil in the large chamber 15*a* is supplied to the small chamber 15*b* to perform the regeneration function.

The second control valve 14*b* may be opened or closed to selectively discharge the hydraulic oil supplied from a third oil line L3 to an oil tank T.

The third oil line L3 may be arranged to allow the large chamber 15*a* of the actuator 15 to communicate with the valve unit 14. The third oil line L3 communicates with the accumulator 16.

In addition, a fourth oil line L4 may be provided to supply the hydraulic oil discharged from the accumulator 16 to the hydraulic motor 12.

A first opening/closing valve 17 may be provided on the fourth oil line L4, and a second opening/closing valve 18 may be provided on the third oil line L3.

The function of the first opening/closing valve 17 and the second opening/closing valve 18 will be described below in conjunction with the related configuration.

The hydraulic oil of the main pump 13 is supplied to the actuator 15 via the first oil line L1 and the second oil line L2 so that a length or angle of the working implement can be adjusted using the hydraulic oil of the main pump 13.

Referring to FIGS. 1 and 2, a first sensor S1 may be provided on the third oil line L3 to detect oil pressure in the actuator 15, and a second sensor S2 may be provided to detect pressure of oil accumulated in the accumulator 16.

The first sensor S1 detects an internal pressure of the actuator 15 and transmits a detected value to the control unit 19.

In addition, the second sensor S2 may be a sensor for detecting pressure of working oil of the accumulator 16 and transmitting a detected value to the control unit 19.

The control unit 19 may be an electronic control unit (ECU) and may refer to a device for controlling various electronic devices of equipment with a computer.

The accumulator 16 may be a hydraulic circuit component serving as a working oil supply source that accumulates surplus working oil in a hydraulic circuit and discharges the accumulated working oil as needed.

For example, when the boom 200 serving as a working implement is moved downward due to its own weight, the hydraulic oil in the large chamber 15*a* of the actuator 15 is discharged, and the discharged hydraulic oil may be accumulated in the accumulator 16 through the third oil line L3. The hydraulic oil accumulated in the accumulator 16 may drive the hydraulic motor 12 so that the hydraulic oil may be reused (regenerated) as a power source when the boom 200 is moved upward.

The accumulator 16 may be a bladder type accumulator using nitrogen gas. In this case, the accumulator 16 accumulates or discharges the working oil by utilizing compressibility of the nitrogen gas and incompressibility of the working oil. Further, the capacity of the accumulator 16 may be arbitrarily set. When a plurality of accumulators are provided, the accumulators may have the same capacity or different capacities.

In other words, the accumulator 16 accumulates a predetermined amount of hydraulic oil pressurized from the main pump 13, or is maintained for a predetermined time after accumulating the hydraulic oil discharged from the large chamber 15*a* when the boom 200 is moved downward as described above and re-supplies the hydraulic oil to the hydraulic motor 12 as needed to serve as an auxiliary power for the main pump 13.

The accumulator 16 may be classified into spring type, weight type, and pneumatic type accumulators according to a pressurizing method, and may be classified into diaphragm type and piston type accumulators according to the structure thereof. An accumulator valve (not shown) may be provided between the accumulator 16 and the third oil line L3. When the accumulator valve is provided, the accumulator 16 may be independently controlled regardless of the control of the first opening/closing valve 17 and the second opening/closing valve 18.

The control unit 19 receives a pressure value which is obtained by detecting pressure of the oil in the actuator 15 through the first sensor S1 and a pressure value which is obtained by detecting pressure of the oil stored in the accumulator 16 through the second sensor S2.

In addition, the control unit 19 calculates a differential value of the received pressure values to control the opening or closing of the first opening/closing valve 17 disposed on the third oil line L3 according to the calculation result.

The first sensor S1 detects the oil pressure in the actuator 15 and transmits the oil pressure value to the control unit 19. Since the pressure of the oil discharged from the main pump 13 is not constant but continuously variable, the first sensor S1 detects the oil pressure in the actuator 15 in real time and transmits the oil pressure value to the controller.

The second sensor S2 detects the pressure of the oil formed in the accumulator 16 and transmits the detected pressure value to the control unit 19.

Since the oil pressure in the accumulator 16 may be continuously changed according to the time of discharging the oil to the hydraulic motor 12 or accumulating the oil in the accumulator 16, the second sensor S2 detects the oil pressure of the accumulator 16 in real time and transmits the oil pressure value to the control unit 19.

When an internal pressure of the accumulator 16 detected by the second sensor S2 is lower than a preset pressure in the process of charging the accumulator 16 with the hydraulic oil, the first opening/closing valve 17 may be closed.

This is for minimizing an impact on an inner wall surface of the accumulator 16 caused by a piston (not shown) that reciprocates with respect to an inner peripheral surface of the accumulator 16 when the accumulator 16 is a piston type, that is, this is for preventing the breakage due to the storing impact applied to the inner wall surface of the accumulator 16 by the piston when a high-pressure oil is charged in the accumulator 16.

The valve unit 14 may be disposed between the first oil line L1 and the second oil line L2.

Although the valve unit 14 is specified as three control valves 14*a*, 14*b*, and 14*c* in the present embodiment, since a plurality of valves corresponding to the number of working implements may be arranged for changing directions, the valve unit 14 may include more than three control valves disposed in the valve unit.

When a plurality of control valves are included, a hydraulic actuator such as a hydraulic motor (not shown) for the lower travelling body 101, the boom cylinder 201, the arm cylinder 301, the bucket cylinder 401, and a swing hydraulic motor (not shown) are connected to a control valve (not shown) and a pressure sensor (not shown) through a high-pressure hydraulic line (not shown) so that the position of each device can be varied using the control unit 19.

Hereinafter, the regeneration method of energy released from the working implement according to the embodiment of the present invention will be described with reference to FIGS. 2 and 3.

First, the pressure of the actuator 15 and the pressure of the accumulator 16 are consecutively detected during the operation of the working vehicle 100 (S100).

The control unit 19 simultaneously receives a detection result detected by the first sensor S1 and a detection value detected by the second sensor S2.

That is, a pressure difference value between the actuator 15 and the accumulator 16 is detected (S100).

Then, the control unit 19 simultaneously receives the detection result output from the first sensor S1 and the detection result transmitted from the second sensor S2, and calculates a difference between the two detection values (S110).

Next, the detection value of the first sensor S1 is compared with the detection value of the second sensor S2 (S120).

Thereafter, when the pressure difference value between the actuator 15 and the accumulator 16 is greater than the preset difference value, the first opening/closing valve 17 is closed (S130).

This signifies that the oil pressure of the actuator 15 is remarkably higher than the oil pressure of the accumulator 16. Since the oil pressure of the actuator 15 is high, the oil is naturally supplied to the accumulator 16 having a relatively low pressure. In this case, the supply of oil from the accumulator 16 to the hydraulic motor 12 may be stopped and the hydraulic oil discharged from the large chamber 15*a* of the actuator 15 is supplied to the accumulator 16 and accumulated therein.

In other words, the supply of the hydraulic oil from the accumulator 16 to the hydraulic motor 12 may be stopped, and the hydraulic oil discharged from the large chamber 15*a* is supplied to the accumulator 16 and accumulated therein.

Meanwhile, when the pressure difference value is smaller than the preset difference value, the first opening/closing valve 17 is controlled to be opened (S140).

This signifies that the oil pressure of the actuator 15 is not significantly different from the oil pressure of the accumulator 16 or is approximate to the oil pressure of the accumulator 16.

As the first opening/closing valve 17 is opened, the hydraulic oil discharged from the large chamber 15*a* of the actuator 15 is supplied to the accumulator 16 and simultaneously the hydraulic oil discharged from the accumulator 16 is supplied to the hydraulic motor 12.

In other words, the oil is accumulated in the accumulator 16 and the regenerative function of the oil to the hydraulic motor 12 is simultaneously performed.

The control unit 19 compares the pressure values, which are input through the first sensor S1 and the second sensor S2, and controls the second opening/closing valve 18 to be closed when it is determined that the oil pressure of the accumulator 16 is greater than the oil pressure of the actuator 15.

In this case, the hydraulic oil in the large chamber 15*a* is supplied to the valve unit 14 along the third oil line L3, and the first control valve 14*a* of the valve unit 14 is controlled to be opened so that the hydraulic oil can be supplied to the small chamber 15*b* along the second oil line L2.

However, since the sectional area of the fluid in the large chamber 15*a* is different from the sectional area of the fluid in the small chamber 15*b* (in the case of a general working vehicle, the sectional area of the fluid in the large chamber is about two times larger than the sectional area of the fluid in the small chamber), the second control valve 14*b* of the valve unit 14 may be opened and the third control valve 14*c* may be closed to supply a part of the oil discharged from the large chamber 15*a* to the oil tank T.

That is, when the hydraulic oil of the large chamber 15*a* is regenerated to the small chamber 15*b*, some of the oil is discharged to the oil tank T via the second control valve 14*b* along the third oil line L3.

FIG. 4 is a time-pressure graph according to a pressure difference value between the actuator and the accumulator in the regeneration system of energy released from the working machine according to the embodiment of the present invention.

Particularly, FIG. 4A shows a time-pressure graph of the actuator 15 and the accumulator 16 when an operator slowly manipulates an operation lever (not shown).

In this case, the pressure difference value between the actuator 15 and the accumulator 16 is larger than the preset difference value and the oil pressure of the accumulator 16 is significantly lower than the pressure of the actuator 15 so that loss corresponding to the pressure difference may occur.

In order to prevent the loss, only the accumulator 16 charged in a state in which the first opening/closing valve 17 is closed until t1 is reached, and then the first opening/closing valve 17 is opened in a region of t1 to t2 where the pressure of the actuator 15 is approximate to the pressure of the accumulator 16, thereby performing the charging and discharging of the accumulator 16 simultaneously.

FIG. 4B shows a time-pressure graph of the actuator 15 and the accumulator 16 when the operator abruptly manipulates the operating lever.

FIG. 4B shows a state in which the pressure difference value between the actuator 15 and the accumulator 16 is smaller than the preset difference value. When the oil pressure of the accumulator 16 is slightly different from the pressure of the actuator 15, the charging and discharging of the accumulator 16 may be performed simultaneously so that the energy loss due to the pressure difference may be minimized.

It will be understood by those of ordinary skill in the art that various changes in form and details may be made without departing from the features and scope of the present invention. Therefore, it is to be understood that the above-described embodiments are illustrative in all aspects and not restrictive. For example, each component described as a single entity may be distributed, and components described as being distributed may also be implemented in a combined form.

The scope of the present invention is defined by the appended claims, and all changes or modifications derived from the meaning and scope of the claims and their equivalents should be construed as being included within the scope of the present invention.

INDUSTRIAL APPLICABILITY

The present invention can improve the energy regeneration efficiency by maintaining pressure of an accumulator at an optimal state when energy is regenerated and the regenerated energy is reused for equipment, from which the energy is regenerated, during the operation of construction equipment.

EXPLANATION OF REFERENCE NUMERALS

11: engine
12: hydraulic motor
13: main pump
14: valve unit
15: actuator
16: accumulator
19: control unit
S1: first sensor
S2: second sensor
L1: first oil line
L2: second oil line
L3: third oil line
L4: fourth oil line

The invention claimed is:

1. A regeneration system of energy released from a working implement, the regeneration system comprising:
an actuator configured to move up and down the working implement;
an accumulator configured to communicate with the actuator; and
a controller configured to receive a pressure value of the actuator and a pressure value of the accumulator to control a discharge operation of a hydraulic oil of the accumulator to a hydraulic motor based on a pressure difference value between the actuator and the accumulator,
wherein the controller controls the accumulator to stop the discharge operation when the pressure value of the actuator is greater than the pressure value of the accumulator and the pressure difference value is greater than a preset difference value,
wherein the controller controls the accumulator to perform the discharge operation when the pressure value of the actuator is greater than the pressure value of the accumulator and the pressure difference value is smaller than a preset difference value.

2. The regeneration system of claim 1, further comprising a first sensor configured to detect an internal pressure of the actuator.

3. The regeneration system of claim 2, further comprising a second sensor configured to detect a pressure of oil accumulated in the accumulator.

4. The regeneration system of claim 3, further comprising a first oil line configured to communicate a main pump for generating a hydraulic pressure with the actuator.

5. The regeneration system of claim 4, further comprising a second oil line disposed between the first oil line and a small chamber of the actuator.

6. The regeneration system of claim 5, further comprising a third oil line configured to communicate the accumulator with a large chamber of the actuator.

7. The regeneration system of claim 6, further comprising a fourth oil line configured to communicate the third oil line with the hydraulic motor.

8. The regeneration system of claim 7, further comprising a first opening/closing valve disposed between the hydraulic motor and the accumulator.

9. The regeneration system of claim 8, further comprising a second opening/closing valve disposed between the accumulator and the large chamber.

10. The regeneration system of claim 9, wherein the second opening/closing valve is controlled to be closed when it is determined that an oil pressure of the accumulator is higher than an oil pressure of the actuator according to the pressure difference value.

11. The regeneration system of claim 8, wherein the first opening/closing valve is controlled to be closed when the pressure difference value is greater than a preset difference value.

12. The regeneration system of claim 8, wherein the first opening/closing valve is controlled to be opened when the pressure difference value is smaller than a preset difference value.

13. The regeneration system of claim 8, wherein the first opening/closing valve is controlled to be closed when a detection value detected by the second sensor is lower than a preset pressure in a process of charging the accumulator with the hydraulic oil.

14. The regeneration system of claim 6, wherein a valve unit is disposed between the first oil line and the second oil line, and
wherein the valve unit includes:
a first control valve which is controlled to be opened or closed such that the small chamber selectively communicates with the third oil line;
a second control valve which is controlled to be opened or closed such that the third oil line selectively communicates with an oil tank; and
a third control valve which is controlled to be opened or closed such that the third oil line selectively communicates with the main pump.

15. The regeneration system of claim 14, wherein the first control valve is closed and the second control valve is opened when the pressure difference value is greater than a preset difference value.

16. A regeneration method of energy released from a working implement of a working vehicle including an actuator for moving up and down the working implement and an accumulator configured to communicate with the actuator, the regeneration method comprising:
detecting a pressure of the actuator and a pressure of the accumulator;
obtaining a pressure difference value between the actuator and the accumulator;
comparing the pressure difference value with a preset difference value;
controlling the accumulator to stop a discharge operation of a hydraulic oil to a hydraulic motor when the pressure value of the actuator is greater than the pressure value of the accumulator and the pressure difference value is greater than the preset difference value; and
controlling the accumulator to perform the discharge operation of the hydraulic oil to the hydraulic motor when the pressure value of the actuator is greater than the pressure value of the accumulator and the pressure difference value is smaller than the preset difference value.

* * * * *